US009470462B2

(12) United States Patent
Ukolowicz et al.

(10) Patent No.: US 9,470,462 B2
(45) Date of Patent: Oct. 18, 2016

(54) HEAT EXCHANGER FOR HEATING HYDROCHLORIC ACID PICKLING SOLUTION, A SYSTEM AND METHOD FOR PICKLING, AND A METHOD OF MANUFACTURING STEEL PRODUCTS

(71) Applicant: TITAN Metal Fabricators, Camarillo, CA (US)

(72) Inventors: Thomas F. Ukolowicz, Camarillo, CA (US); Steven F. Muscarella, Camarillo, CA (US)

(73) Assignee: Titan Metal Fabricators, Camarillo, CA (US)

( * ) Notice: Subject to any disclaimer, the term of this patent is extended or adjusted under 35 U.S.C. 154(b) by 456 days.

(21) Appl. No.: 14/104,421

(22) Filed: Dec. 12, 2013

(65) Prior Publication Data

US 2014/0165686 A1 Jun. 19, 2014

Related U.S. Application Data

(60) Provisional application No. 61/737,126, filed on Dec. 14, 2012.

(51) Int. Cl.
*B21B 27/06* (2006.01)
*F28F 21/08* (2006.01)
(Continued)

(52) U.S. Cl.
CPC ..... *F28F 21/081* (2013.01); *B21B 27/06* (2013.01); *C22C 27/02* (2013.01); *C23G 3/00* (2013.01); *C23G 3/021* (2013.01); *F28D 1/0213* (2013.01); *Y10T 428/12* (2015.01)

(58) Field of Classification Search
CPC .... F28F 21/081; F28D 1/0213; B21B 27/06; C22C 27/02; C23G 3/00; C23G 3/021; Y10T 428/12
USPC ..... 72/200
See application file for complete search history.

(56) References Cited

U.S. PATENT DOCUMENTS 2,428,221 A 9/1947 Hudson
2,907,654 A 10/1959 Thielemann
(Continued)

FOREIGN PATENT DOCUMENTS

DE 10 94 467 B 12/1960
GB 821796 10/1959
(Continued)

OTHER PUBLICATIONS

Nguyen and Farina, Corrosion Resistance and Behavioral Characteristics of Metals Exposed to 70 Percent by Weight Sulfuric Acid at Elevated Temperatures, 1994, Tennessee Valley Authority, Muscle Shoals, Alabama.
(Continued)

*Primary Examiner* — David B Jones
(74) *Attorney, Agent, or Firm* — Michael P. Alexander

(57) ABSTRACT

A component for a steel pickling apparatus is formed from an alloy that predominately comprises niobium and tantalum. The component may be a heat exchanger component, such as a tube or tubesheet liner, formed from the alloy that predominately comprises niobium and tantalum. Also, disclosed is a heat exchanger including the component, a system and method for pickling using the heat exchanger, and a method of manufacturing a steel product including the method of pickling.

30 Claims, 9 Drawing Sheets

(51) Int. Cl.

| | |
|---|---|
| ***F28D 1/02*** | (2006.01) |
| ***C22C 27/02*** | (2006.01) |
| ***C23G 3/00*** | (2006.01) |
| ***C23G 3/02*** | (2006.01) |

(56) References Cited

U.S. PATENT DOCUMENTS

| | | | | |
|---|---|---|---|---|
| 2,922,714 | A | | 1/1960 | Benham |
| 2,957,764 | A | | 10/1960 | Michael |
| 3,186,837 | A | | 6/1965 | Duffek |
| 3,445,284 | A | | 5/1969 | Robinson, Jr. et al. |
| 3,785,787 | A | * | 1/1974 | Yokota ..... C22C 38/42 420/45 |
| 4,197,139 | A | | 4/1980 | Hjersted |
| 4,526,749 | A | | 7/1985 | Huber |
| 5,108,544 | A | | 4/1992 | Hakansson |
| 5,242,552 | A | * | 9/1993 | Coin ..... C25B 1/46 205/556 |
| 7,994,692 | B2 | | 8/2011 | Spaniol |
| 2001/0032716 | A1 | | 10/2001 | Consilius |
| 2002/0139667 | A1 | | 10/2002 | Wang |
| 2003/0049154 | A1 | | 3/2003 | Xu et al. |
| 2004/0062676 | A1 | | 4/2004 | Trotzschel et al. |
| 2006/0027628 | A1 | | 2/2006 | Sutherlin |
| 2007/0221300 | A1 | | 9/2007 | Wachter et al. |
| 2011/0197681 | A1 | | 8/2011 | Rieder et al. |

FOREIGN PATENT DOCUMENTS

| | | |
|---|---|---|
| GB | 831932 | 4/1960 |
| GB | 839944 | 6/1960 |
| GB | 933712 | 8/1963 |
| WO | 0205863 A1 | 1/2002 |

OTHER PUBLICATIONS

Robin, Abstract of Corrosion behavior of niobium, tantalum and their alloys in boiling sulfuric acid solutions, International Journal of Refractory Metals and Hard Materials, 1997, vol. 15, Issues 5-6.

* cited by examiner

HEAT EXCHANGER FOR HEATING HYDROCHLORIC ACID PICKLING SOLUTION, A SYSTEM AND METHOD FOR PICKLING, AND A METHOD OF MANUFACTURING STEEL PRODUCTS

CROSS-REFERENCE TO RELATE APPLICATION

The present application claims the priority of U.S. Provisional Patent Application No. 61/737,126 filed Dec. 14, 2012, which is incorporated herein by reference in its entirety.

BACKGROUND OF THE INVENTION

1. Field of the Invention

The present invention relates to components for a steel pickling apparatus, such as heat exchanger components for heating hydrochloric acid pickling solutions, and related systems and methods.

2. Description of Related Art

When steel is exposed to oxygen at high temperatures, such as during or after hot rolling, the oxygen chemically reacts with a hot surface of the steel and forms a compound normally referred to as scale. This scale generally must be removed prior to further processing such as cold rolling, drawing, stamping, etc.

Scale can be removed by mechanical methods. However, mechanical scale removal damages the surface of the steel. As an alternative, removal of scale by chemical processing allows for quick and clean removal of scale without surface damage. This method of scale removal is commonly referred to as pickling, and at first was generally conducted using sulfuric acid.

In the early 1960's a major change in high speed pickling technology took place—the introduction of hydrochloric acid (HCl) pickling. Hydrochloric acid became an attractive alternative to sulfuric acid because it could be regenerated and because it permitted higher pickling speeds. However, hydrochloric acid had its disadvantages. One disadvantage is that hydrochloric acid is much more corrosive than sulfuric acid, creating challenges with materials used to handle the hydrochloric acid.

Temperature and concentration of the pickling bath plays an important role in pickling efficiency. The pickling rate considerably increases with an increase in the pickling bath concentration and temperature. Therefore, to increase pickling speeds, high concentrations of hydrochloric acid are heated to high temperatures, as high as approximately 22 weight percent hydrochloric acid and approximately 210° F. (99° C.).

To maintain the high temperature of the pickling bath, graphite heat exchangers may be used. However, these graphite heat exchangers have less efficiency due to cross-contamination of steam and acid, frequent leakages, clogging of pores, and regular need for maintenance.

Alternatively, direct steam injection in the bath may be used to maintain the high pickling bath temperature. However, this leads to pickling bath dilution, which reduces the acid concentration and, thereby, reduces the pickling efficiency.

Using a heat exchanger including polytetrafluoroethylene (PTFE) tubing is also possible. However, installation of a PTFE heat exchanger is not feasible for all pickling applications.

Other types of heat exchangers may be used to maintain the high acid temperatures. For example, a heat exchanger may include metal tubing that transmits heat between a hydrochloric acid solution contacting one surface of the tubing and a heating fluid such as steam contacting an opposing surface of the tubing. Thereby, heat is conducted from the steam to the hydrochloric acid solution. The conductive portions of the heat exchanger that come into contact with the hydrochloric acid solution must have high resistance to corrosion in acidic and chloride-containing environments in order to attain an adequate service life. Additionally, portions of the heat exchanger that act as a medium for heat transfer should have have high thermal conductivity to permit efficient heating of the hydrochloric acid.

Conventionally, tantalum (Ta) is the primary alloy used in heat exchanger tubing for heating highly-concentrated hydrochloric acid pickling solutions used in pickling of carbon steel. Tantalum is one of the most corrosion resistant materials available. At temperatures under 300° F. (149° C.), tantalum is regarded as being inert to all concentrations of hydrochloric acid. Additionally, tantalum has a thermal conductivity of 32 Btu/hr-ft° F. (57.5 W/m-K), which provides for excellent heat transfer between the heating fluid and the hydrochloric acid solution. However, tantalum is expensive (approximately $300/lb; $0.66/g) and has a high density (16.6 g/cm$^3$). Therefore, the cost for producing a desired thickness of tantalum is very expensive.

The excellent corrosion resistance of tantalum heat exchangers allows heat exchanger tubing to remain in service indefinitely. However, due to the high cost of tantalum, only the parts of the heat exchanger that contact the hydrochloric acid are formed from tantalum. Other parts of the heat exchanger are formed from other materials, such as carbon steel.

A pickling line in a steel mill is a very difficult environment. Most heat exchangers fail not because of failure of the tantalum tubing but instead from corrosion of the steel parts or from lack of maintenance. Although solids in the pickling acid should be screened out, the filters may fill up rapidly and are often bypassed. Thus, these heat exchangers can foul and require cleaning. Accordingly, the heat exchangers typically fail in less than 10 years depending on the level of maintenance and the specific application of the heat exchanger.

SUMMARY

According to one or more embodiments, it is an object to provide a component for a steel pickling apparatus, such as for a heat exchanger for heating hydrochloric acid pickling solutions, that overcomes one or more problems of the prior art.

It is another object to reduce the cost of a component for a steel pickling apparatus while providing excellent corrosion resistance in high concentrations of hydrochloric acid at high temperatures.

It is another object to reduce the cost of a heat exchanger while ensuring a five year lifetime of the acid-contacting surfaces, preferably a ten year lifetime, and more preferably a twenty year lifetime, even in high concentrations of hydrochloric acid at temperatures in excess of the boiling temperature of hydrochloric acid.

According to an exemplary embodiment, there is a component for steel pickling apparatus, wherein the component is formed from an alloy that predominately comprises niobium and tantalum. The alloy may include at least 30 weight percent tantalum, preferably at least 45 weight percent tantalum, more preferably at least 55 weight percent tantalum. The alloy may include at least 25 weight percent niobium, preferably at least 35 weight percent niobium. The component may be a heat exchanger component, such as a tube or tubesheet liner.

According to another exemplary embodiment, there is a heat exchanger for heating a hydrochloric acid pickling solution. The heat exchanger may include at least one tube formed from an alloy that predominately comprises niobium and tantalum. The alloy may include at least 30 weight percent tantalum, preferably at least 45 weight percent tantalum, more preferably at least 55 weight percent tantalum. The alloy may include at least 25 weight percent niobium, preferably at least 35 weight percent niobium. A wall thickness of the tube may be 0.1 inch (2.54 mm) or less, preferably 0.03 inch (0.76 mm) or less, more preferably 0.015 inch (0.38 mm) or less.

In an exemplary embodiment, the heat exchanger may further include: a first tubesheet disposed at a first end of a plurality of the tubes, a second tubesheet disposed at a second end of the plurality of tubes; and a shell surrounding the plurality of tubes, the shell comprising: a tubeside inlet for flowing hydrochloric acid through the first tubesheet and the plurality of tubes; a tubeside outlet for flowing the heated hydrochloric acid from the plurality of tubes and the second tubesheet; a shellside inlet for flowing a heating fluid into the shell to heat the plurality of tubes; and a shellside outlet for flowing the heating fluid out of the shell. The first and second tubesheets may include substrate formed of a material other than the alloy that predominately comprises niobium and tantalum, wherein a liner is disposed on a side of each tubesheet facing away from the plurality of tubes, and wherein the liner is formed from the alloy that predominately comprises niobium and tantalum. The shellside outlet may include a shellside vent for releasing non-condensables from the shell and a shellside drain for draining excess liquid.

In another exemplary embodiment, the heat exchanger may include: a steam inlet; a coil of the at least one tube, wherein the coil transfers heat from steam passing therethrough to hydrochloric acid contacting an exterior of the coil; and a condensate outlet for removing condensed steam from the coil. The heat exchanger may further include an inlet manifold that separates the steam from into a plurality of tubes, and an outlet manifold that merges condensed steam from the plurality of tubes. The heat exchanger may further include a cage for supporting the coil, wherein the cage assembly comprises at least one of polypropylene and polytetrafluoroethylene.

In another exemplary embodiment of the present invention, there is a system for pickling including: a pickling tank containing hydrochloric acid; and a heat exchanger as described above in fluid communication with the pickling tank for heating the hydrochloric acid.

In another exemplary embodiment of the present invention, there is a method for picking including: passing a steel product through a pickling tank containing hydrochloric acid; and heating the hydrochloric acid with a heat exchanger as described above. In a preferred embodiment, at least the tubewall of the at least one tube contacts the hydrochloric acid is heated above the boiling point of the hydrochloric acid.

In yet another exemplary embodiment of the present invention, there is a method of manufacturing a steel product, including hot rolling a steel to form a hot rolled strip product, and pickling the strip according to the method of pickling as described above.

These and other features and characteristics, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. As used in the specification and the claims, the singular form of "a", "an", and "the" include plural referents unless the context clearly dictates otherwise.

DETAILED DESCRIPTION OF THE ILLUSTRATED EMBODIMENTS

Figure 1:
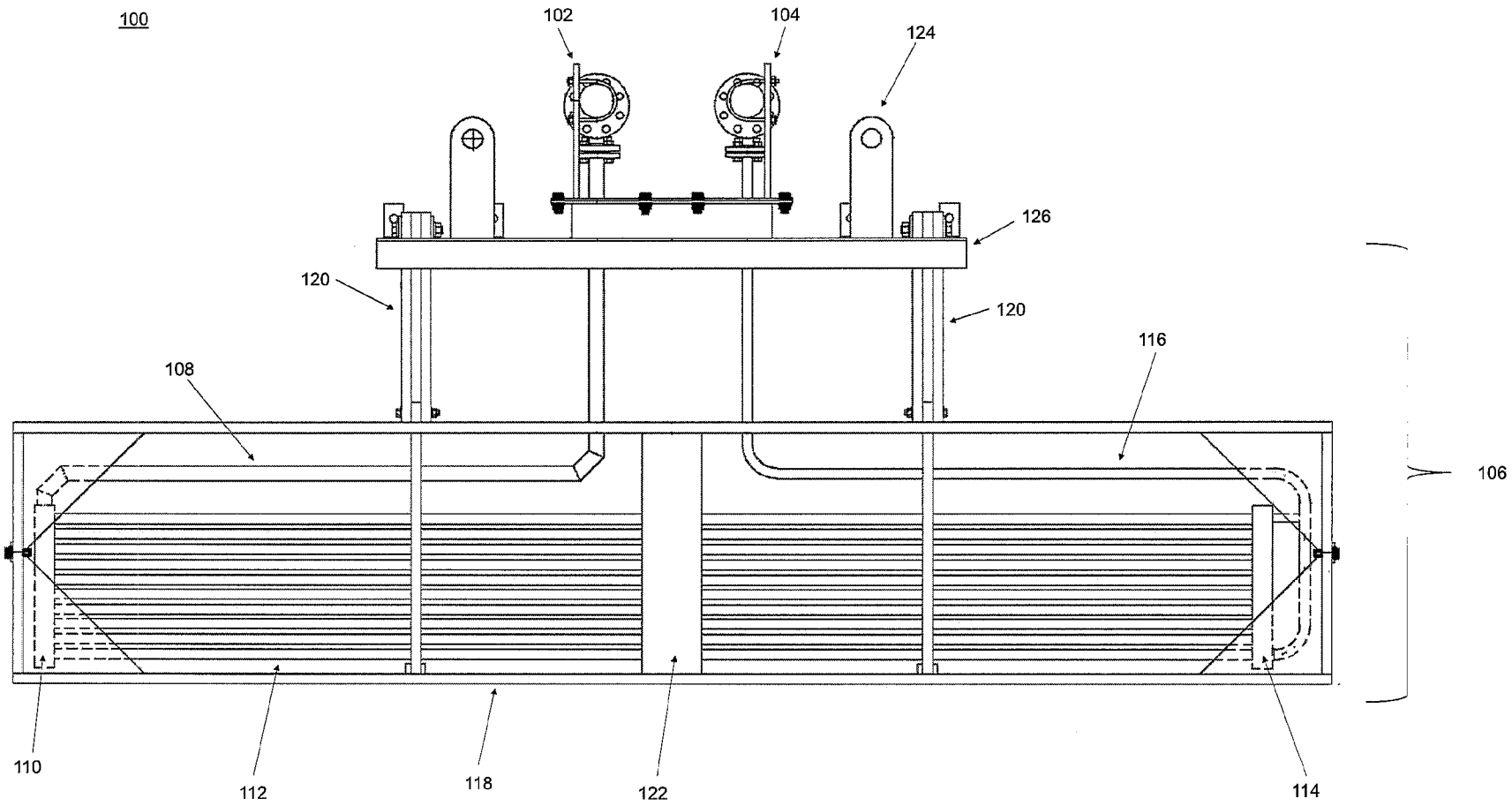
FIG. 1 illustrates a front view of an exemplary immersion coil heat exchanger according to an embodiment of the present invention, with hidden portions shown with dotted lines.

This specification describes all compositions in weight percent, unless specifically expressed otherwise.

According to an embodiment of the present invention, a component for a steel pickling apparatus is formed from an alloy that predominately comprises niobium and tantalum with additions of small amounts of other elements. Preferably, the alloy includes a total of niobium and tantalum of at least 92 weight percent to ensure adequate corrosion resistance in hydrochloric acid solutions. The reasons for the selection of the elemental composition of the component are described as follows.

Tantalum

Tantalum provides the alloy with excellent corrosion resistance, although at a high cost. When the alloy contains less than 30 weight percent tantalum, the alloy remains corrosion resistant when exposed to low concentrations of hydrochloric acid, but corrosion resistance deteriorates when exposed to high concentrations of hydrochloric acid. Accordingly, the alloy preferably contains at least 30 weight percent tantalum, more preferably at least 45 weight percent, and even more preferably at least 55 weight percent. Increasing concentrations of tantalum increase the corrosion resistance of the alloy when exposed to high concentrations of hydrochloric acid at high temperatures.

Niobium

Niobium is required in the alloy composition for adequate corrosion resistance in hydrochloric acid as well as to reduce the material cost of the component. Preferably, the alloy contains at least 25 weight percent niobium to provide a good combination of corrosion resistance and material cost savings, and more preferably at least 35 weight percent niobium.

Other Elements

It is envisioned that additional elements may be added to the composition as long as they do not significantly detract from the corrosion resistance of the component, preferably to a maximum of 8 weight percent of other elements. More specifically, the alloy may include a maximum of 6 weight percent of tungsten and/or molybdenum, which may increase the strength of the alloy, and the alloy may include a maximum of 2 weight percent of precious metals (for example, platinum, palladium, or ruthenium), which may improve hydrogen embrittlement resistance.

A preferred tantalum content of the alloy is from 30 to 90 weight percent tantalum, more preferably 45 to 75 weight percent, even more preferably 55 to 65 weight percent. A preferred niobium content of the alloy is from 10 to 70 weight percent niobium, more preferably 25 to 55 weight percent niobium, and even more preferably 45 to 55 weight percent niobium. Up to 8 weight percent of the niobium may be replaced with elements other than niobium and tantalum, such that the alloy includes a total of niobium and tantalum of at least 92 weight percent.

According to an embodiment of the present invention, the component may be a heat exchanger component such as a tube or tubesheet liner used in a heat exchanger to exchange heat between an acid solution and a heating fluid, such as steam. According to preferred tubing configurations, the wall thickness of the tube and/or tubesheet liner may be 0.1 inch (2.54 mm) or less, preferably 0.03 inch (0.76 mm) or less, and more preferably 0.015 inch (0.38 mm) or less.

Immersion Coil Heat Exchanger

Figure 2:
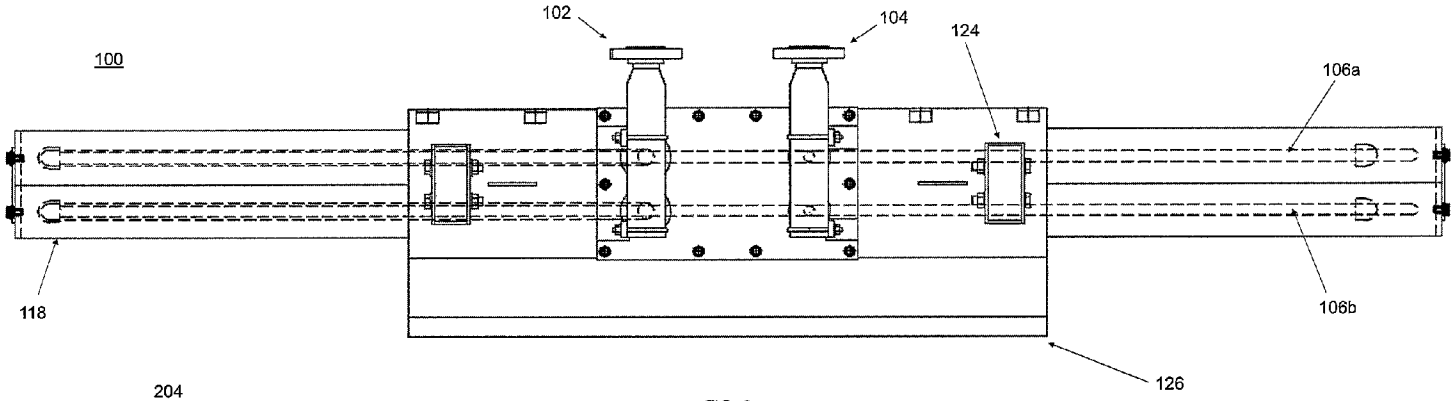
FIG. 2 illustrates a top view of the immersion coil heat exchanger of FIG. 1, with hidden portions shown with dotted lines.
Figure 3:
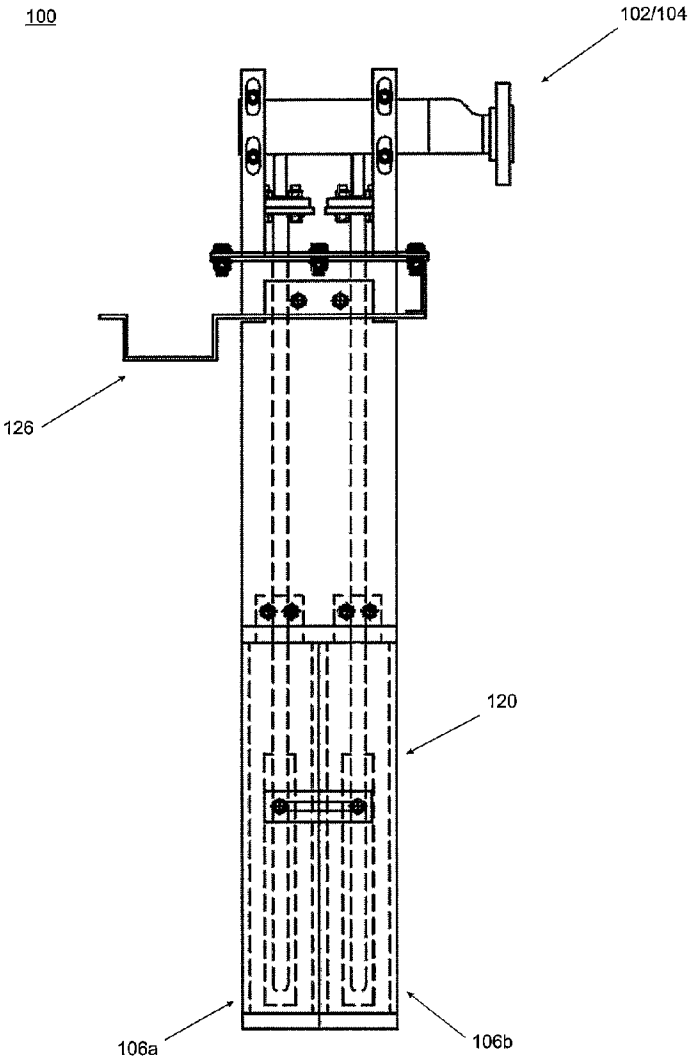
FIG. 3 illustrates a side view of the immersion coil heat exchanger of FIG. 1, with hidden portions shown with dotted lines.

FIGS. 1-3 illustrate an exemplary immersion coil heat exchanger according to an embodiment of the present invention, with hidden portions shown with dotted lines.

The immersion coil heat exchanger (100) is designed to be immersed into a hydrochloric acid bath, particularly of the type which may be used in a pickling line for pickling of steel, which baths typically have a concentration of hydrochloric acid between 4 weight percent and 22 weight percent.

The immersion coil heat exchanger (100) may include a steam inlet (102), a condensate outlet (104), and a coil (106). A heating fluid, such as steam, may be pumped into the steam inlet (102), through the coil (106), and out through the condensate outlet (104). By passing the heating fluid through the coil (106), the coil (106) is thereby heated to effect heating of the hydrochloric acid bath.

The coil (106) may include one or more hollow tubes through which the heating fluid may pass. The coil (106) should preferably have a high thermal conductivity so to efficiently allow heat transfer between the heating fluid within the coil (106) and the surrounding hydrochloric acid. The coil (106) must have excellent corrosion resistance and good heat resistance so that it tolerates the high temperatures of the acid bath. According to the present invention, the coil (106) includes an alloy that predominately comprises niobium and tantalum as described previously in greater detail.

As illustrated in the embodiment of FIGS. 1-3, the coil (106) may include an inlet tube, such as inlet riser (108), an inlet manifold (110), a plurality of tube branches (112), an outlet manifold (114), and an outlet tube, such as outlet riser (116). In this case, the coil (106) passes heating fluid from the steam inlet (102) through the inlet riser (108) to the inlet manifold (110), which splits the flow of the heating fluid into the plurality of tube branches (112). The tube branches (108) then pass the heating fluid through the outlet manifold (114) where the flow recombines and the heating fluid travels through the outlet rise (116) to the condensate outlet (104). Although not illustrated, the coil (106) may alternatively remain in a single pathway.

In the illustrated embodiment of FIGS. 1-3, at least one of the plurality of tube branches (112) includes an alloy that predominately comprises niobium and tantalum as previously described. Preferably, all of the plurality of tube branches (112) includes the alloy of the present invention, and more preferably, all of the inlet riser (108), the inlet manifold (110), the plurality of tube branches (112), the outlet manifold (114), and the outlet riser (116) include the alloy of the present invention.

The immersion coil heat exchanger (100) may further include a cage (118) for enclosing the coil (106). The heat exchanger (100) may further include cage support (120) for supporting the cage (118). The cage (118) and cage support (120) are preferably formed of a corrosion-resistant thermoplastic polymer, such as polypropylene, with high temperature corrosion resistance upon exposure to boiling hydrochloric acid.

The cage (118) may further include a tube stringer (122) for holding the coil (106). The tube stringer (122) and other parts of the cage (not shown) that contact the surfaces of the coil (106) are preferably formed of a corrosion-resistant thermoplastic polymer such as polytetrafluoroethylene (PTFE) with high temperature resistance upon exposure to super heated of hydrochloric acid.

The immersion coil heat exchanger (100) may further include structures for supporting the heat exchanger, such as one or more lifting structures, such as lifting lugs (124) to facilitate raising and lowering the immersion coil heat exchanger (100), and/or one or more stabilizing structures, such as top plate (126) that engages with an external structure (not shown) to prevent the immersion coil heat exchanger (100) from swinging.

As illustrated in FIG. 3, the immersion coil heat exchanger (100) may include a first coil (101*a*) and a second coil (101*b*). As illustrated, the first coil (101*a*) and the second coil (101*b*) may share the same steam inlet (102) and condensate outlet (114).

Shell and Tube Heat Exchanger

Figure 6:
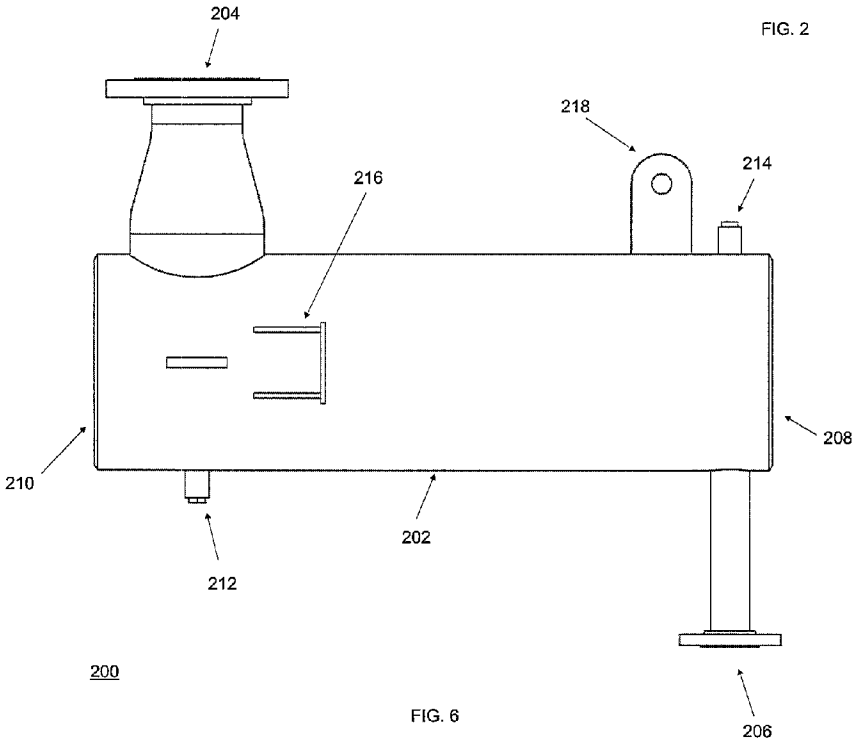
FIG. 6 illustrates a front view of the shell of the shell and tube heat exchanger of FIG. 4.
Figure 5:
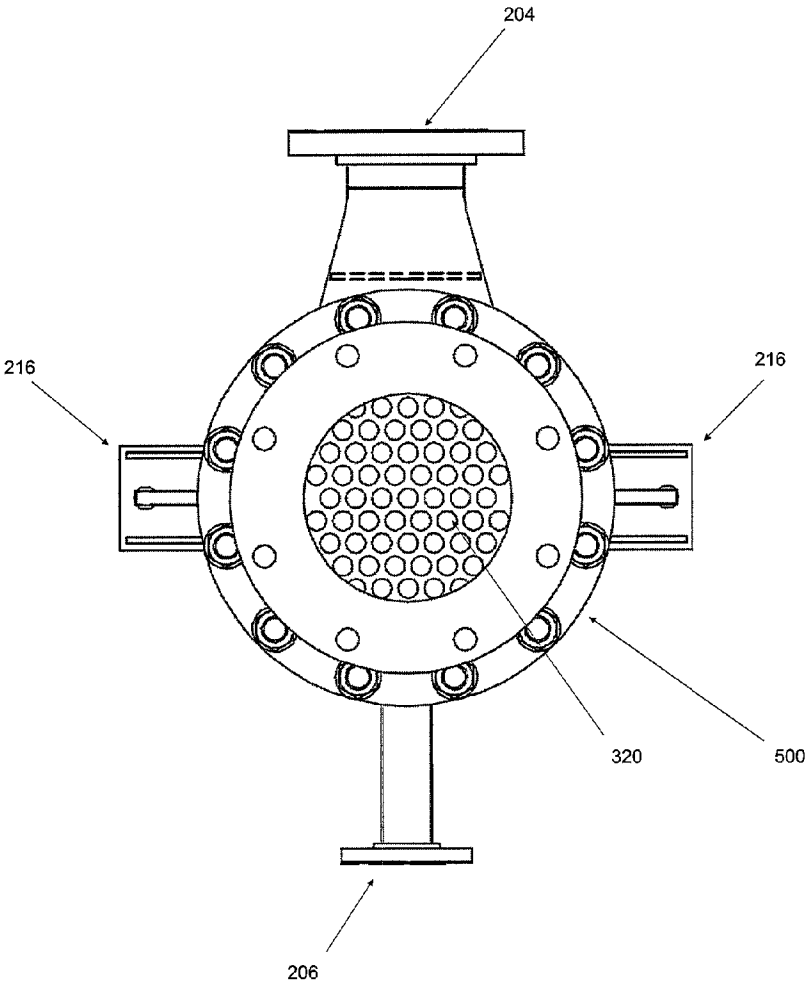
FIG. 5 illustrates a left side view of the shell and tube heat exchanger of FIG. 4.
Figure 4:
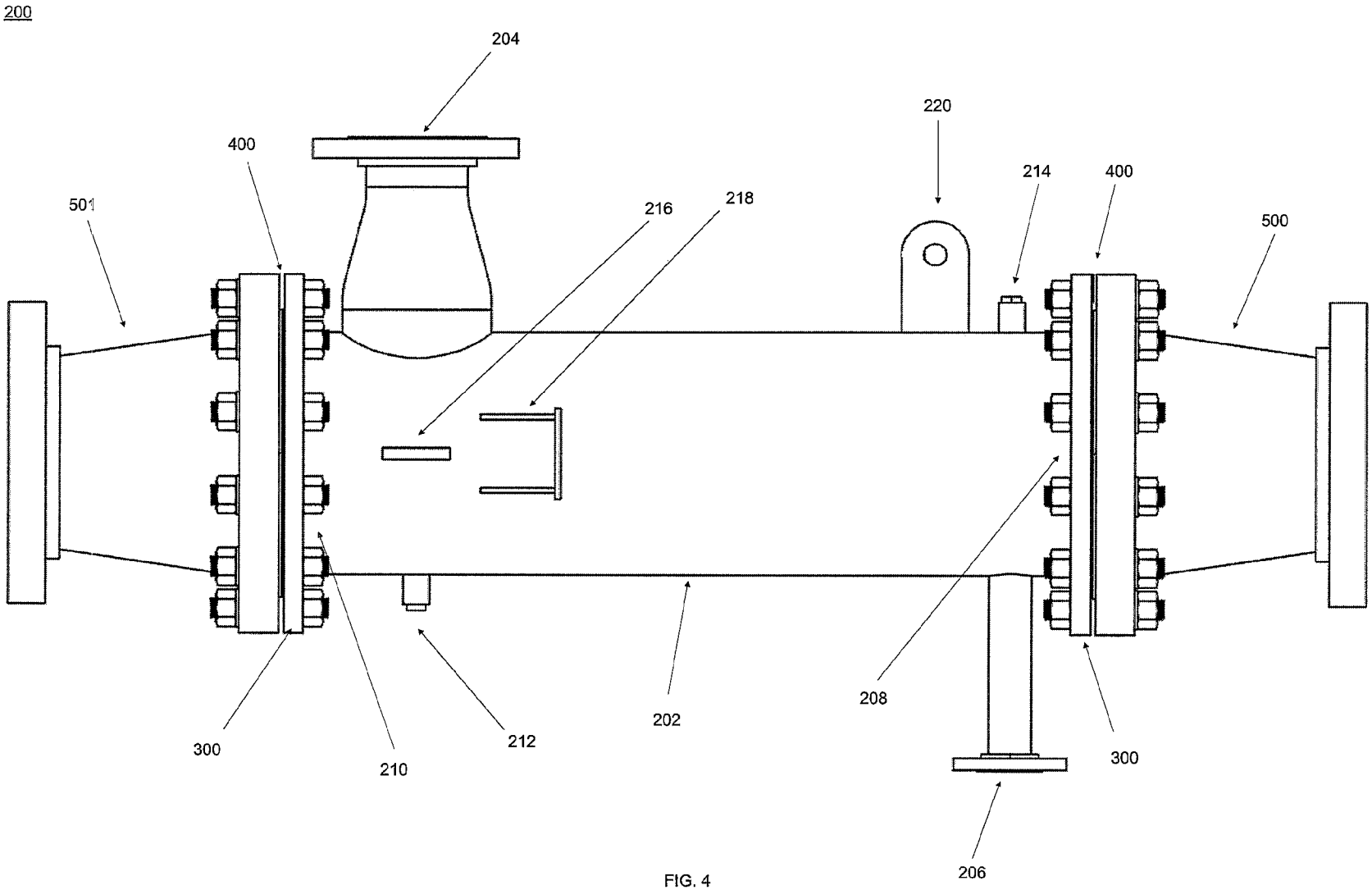
FIG. 4 illustrates a front view of an exemplary shell and tube heat exchanger according to an embodiment of the present invention.

FIGS. 4-6 illustrate an exemplary shell and tube heat exchanger (200) according to an embodiment of the present invention.

The shell and tube heat exchanger (200) includes a plurality of tubes (320) and a shell (202) surrounding the plurality of tubes (320). A heating fluid such as steam may be pumped into the shell (202), where the heating fluid comes into contact with the outside of the plurality of tubes (320), thereby heating hydrochloric acid passing through the interior of the plurality of tubes (320). According to all embodiments of the present invention, at least one, and preferably all, of the plurality of tubes (32) include an alloy that predominately comprises niobium and tantalum as described previously in greater detail.

The shell (202) may include a shellside inlet (204) and a shellside outlet (206). In a case where the heating fluid is steam, the steam may be pumped into the shellside inlet (204) after which the steam condenses upon contacting the plurality of tubes (320), and the condensed steam may be extracted from the shell (202) via the shellside outlet (206).

The shell (202) may include a tubeside inlet (208) and a tubeside outlet (210). In this case, the plurality of tubes (320) pass through the tubeside inlet (208), extend into the shell (202), and pass out through the tubeside outlet (210). By passing the plurality of tubes (320) through the shell (202), the plurality of tubes (320) and the acid flowing therethrough are heated by contact with the steam flowing outside of the plurality of tubes (320).

The shell (202) may further include a shellside vent (212) for releasing non-condensables such as air. The shell (202) may further include a shellside drain (214) for draining excess liquid.

The shell (202) may further include structures for supporting the heat exchanger (200), such as one or more lifting lugs (216) and/or lifting lug supports (218) to facilitate raising and lowering the heat exchanger (200). The shell (202) may further include one or more tailing lugs (220) to aid in hoisting the heat exchanger (200) into a desired position.

Figure 8:
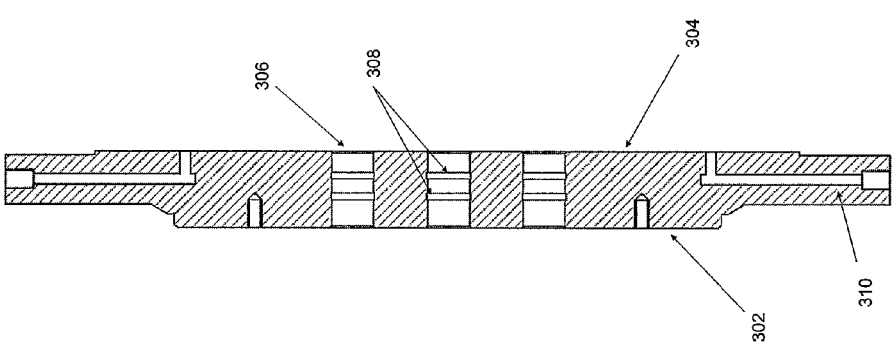
FIG. 8 illustrates a sectional view of the tubesheet of FIG. 7, sectioned along line A-A.
Figure 7:
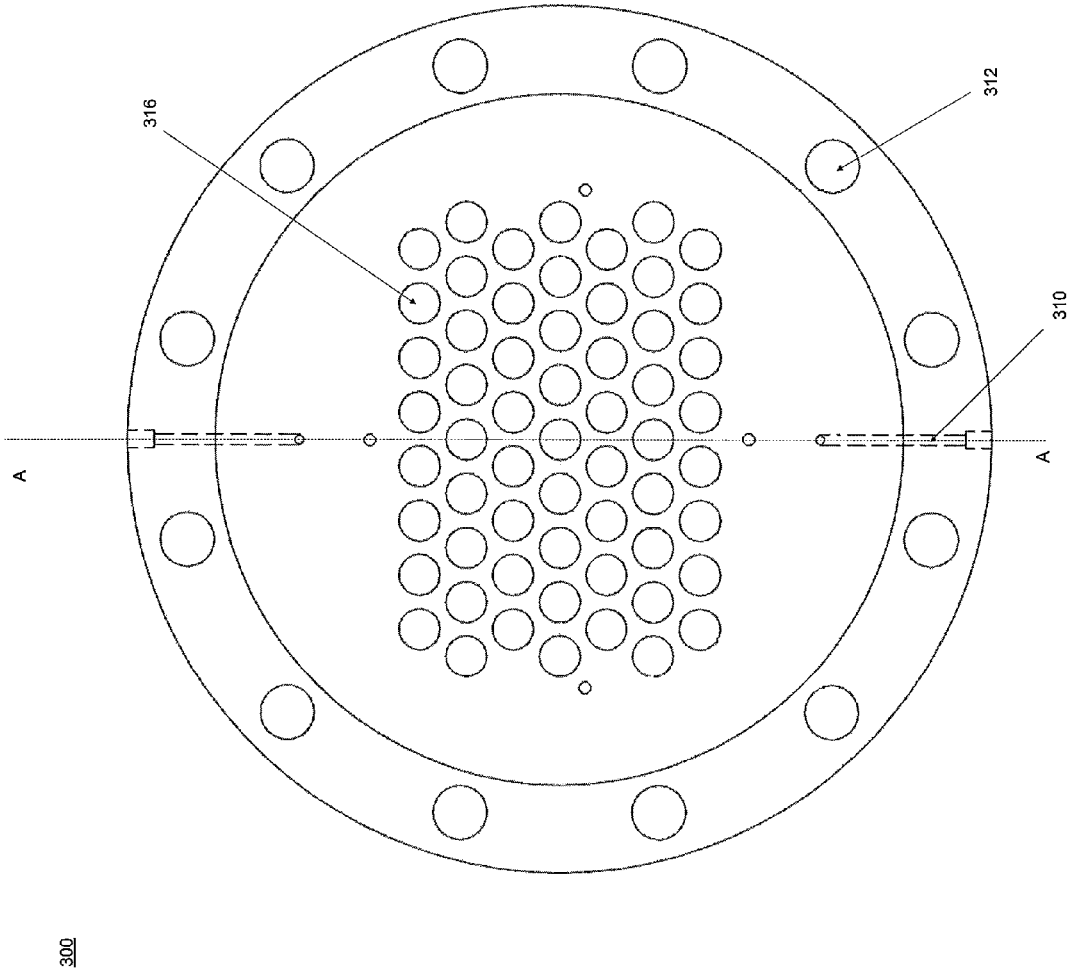
FIG. 7 illustrates a front view of a tubesheet of the shell and tube heat exchanger of FIG. 4, facing the tubeside face.

The heat exchanger (200) may further include a tubesheet assembly at each of the tubeside inlet (208) and the tubeside outlet (210). The tubesheet assembly may include a tubesheet (300). FIG. 7 illustrates a front view of an exemplary tubesheet (300), and FIG. 8 illustrates a sectional view of the exemplary tubesheet (300) along line A-A of FIG. 7.

As illustrated, the tubesheet (300) includes a shellside face (302) for facing the interior of the shell (202), a tubeside face (304) for facing an exterior of the shell (202), and a plurality of tube holes (306) for passing the plurality of tubes (320) therethrough. To firmly attach the plurality of tubes (320) into the tubesheet (300), the tubes holes (306) preferably include grooves (308), and the plurality of tubes (320) are preferably roller-expanded into the grooves (308) of the tubesheet (300).

The shellside face (302) does not require corrosion resistance to hydrochloric acid. However, as illustrated, the hydrochloric acid entering and exiting the plurality of tubes (520) at the tubeside inlet (208) and the tubeside outlet (210) will not be contained by the plurality of the tubes (520). Accordingly, tubeside face (304) of the tubesheet (300) would be exposed to the hydrochloric acid.

Accordingly, the tubesheet (300), which may be formed from a low cost metal, such as carbon steel, is combined with a liner (314) formed from an alloy that predominately comprises niobium and tantalum of the present invention, the liner being disposed on the tubeside face (204) of the tubesheet (300). The tubesheet (300) may further include a tell tale port (310), which is to be covered by the liner (314) for detecting a leak in the tubesheet assembly. The tubesheet (300) may further include fastening holes (312) for fastening the tubesheet (300) with an external conduit for transporting the hydrochloric acid to be heated by the heat exchanger (200) or the hydrochloric acid that has been heated by the heated exchanger (200).

Figure 10:
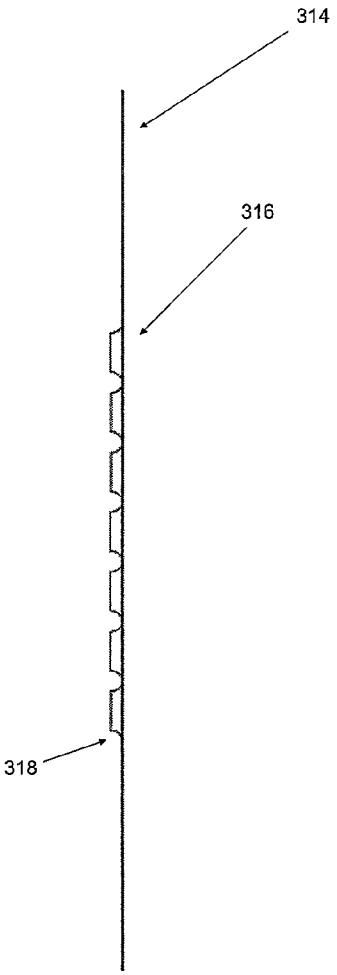
FIG. 10 illustrates a right side view of the liner of FIG. 9.
Figure 9:
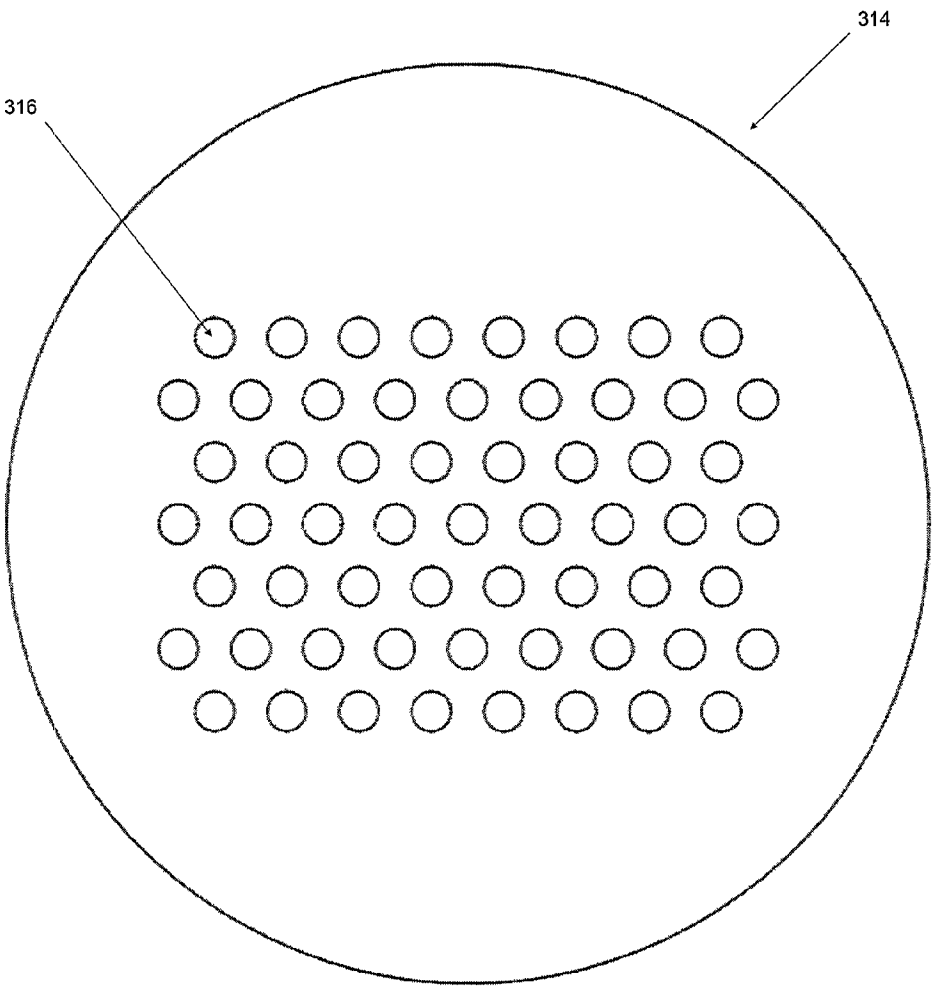
FIG. 9 illustrates a front view of a liner of the shell and tube heat exchanger of FIG. 4.

FIGS. 9-10 illustrate a liner (314) of the shell and tube heat exchanger of FIG. 4. The liner (314) includes liner holes (316) for passing through the plurality of tubes (320). The liner may include hole edges (318) that slant inwardly in a direction of the tubeside face of the liner (314). The hole edges (318) may be formed by a process such as swaging.

Figure 11:
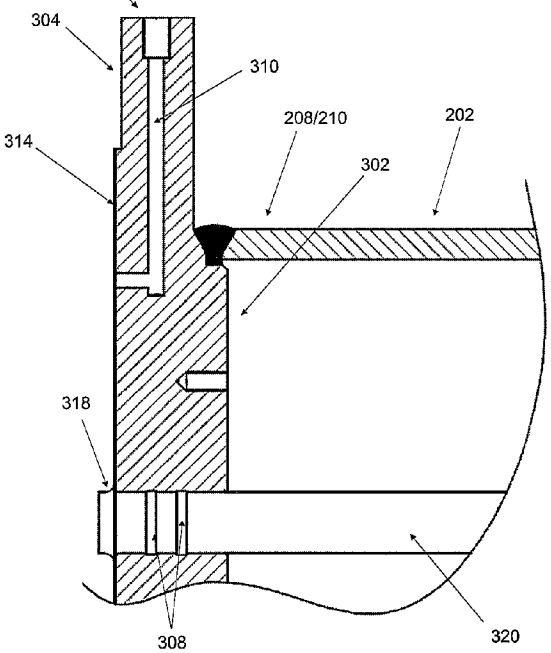
FIG. 11 illustrates a partial sectional view of a tubesheet assembly attached to a shell according to an example of the shell and tube heat exchanger of FIG. 4.
Figure 12:
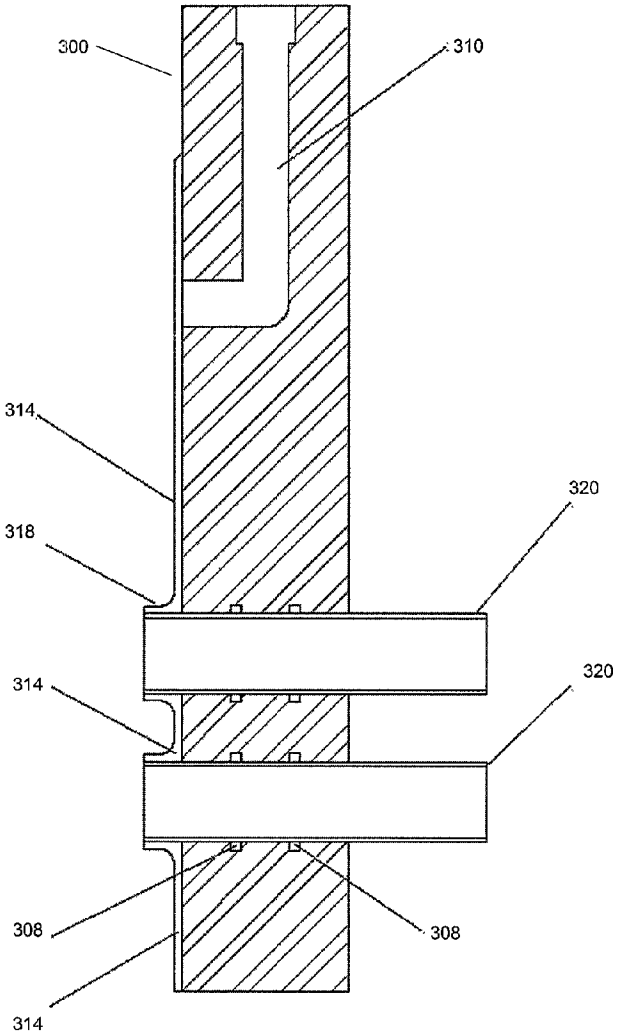
FIG. 12 illustrates another partial sectional view representing a tubesheet assembly according to an example of the shell and tube heat exchanger of FIG. 4.

FIG. 11 illustrates a partial sectional view of a tubesheet assembly attached to a shell according to an example of the shell and tube heat exchanger of FIG. 4, and FIG. 12 illustrates another partial sectional view representing a tubesheet assembly according to an example of the shell and tube heat exchanger of FIG. 4.

As previously mentioned, the plurality of tubes (320) may be attached into the tube holes (306) by roller expanding the tubes (320) into the grooves (308) of the tube holes (306) as illustrated in FIG. 11.

Also, as illustrated in FIG. 11, the shell (202) may be metallurgically joined to the tubesheet (300) by a process such as welding.

Additionally, as illustrated in FIG. 12, the hole edges (318) of the liner (314) may be metallurgically joined to the tubes (320) by a process such as welding. Although it is not necessary to join the liner (314) to the tubesheet (300), the liner (314) may be metallurically joined to tubesheet (300) by a process such a brazing as shown in FIG. 12.

The heat exchanger (200) may further include gaskets (400), inlet plenum (500) and outlet plenum (501). The inlet plenum (500) and outlet plenum (501) may be fastened to the tubesheet (300) at each end of the heat exchanger (200), such as by the fastening holes shown in FIG. 4. Gaskets (400) are placed between each of the plenums (500, 501) and tubesheets (300) to prevent against leaks therebetween.

As previously mentioned, the heating fluid such as steam may be pumped through the shellside inlet (204) into the shell (202), where the heating fluid comes into contact with the outside of the plurality of tubes (320). The heating fluid then comes out of the shell (202) through the shellside outlet (206) after which it may be reheated and recirculated. In the case of the heating fluid being steam, the steam is condensed by contacting the outside of the plurality of tubes (320), and the condensed steam comes out of the shell (202) through the shellside outlet (206) after which it may be sent to a boiler to be revaporized.

A hydrochloric acid solution contacts the liner (314) at the tubeside face (304) of the tubesheet (300), may pass in through the inlet plenum (500), and flow into the plurality of tubes (508). The hydrochloric acid then passes out of the tubes (320), contacts the liner (314) at the tubeside face (304) of the tubesheet (300) and passes through the outlet plenum (501).

The heated hydrochloric acid may then be transported into a pickling bath (not shown) and thereafter recirculated again through the shell and tube heat exchanger (200) for further heating.

One or more of the acid-contacting surfaces of the inlet plenum (500) and outlet plenum (501) may include an alloy that predominately comprises tantalum and niobium as previously described. Alternatively, the acid-contacting surfaces of the inlet plenum (500) and outlet plenum (501) may include a corrosion resistant fluorocarbon polymer such as PTFE.

Figure 13:
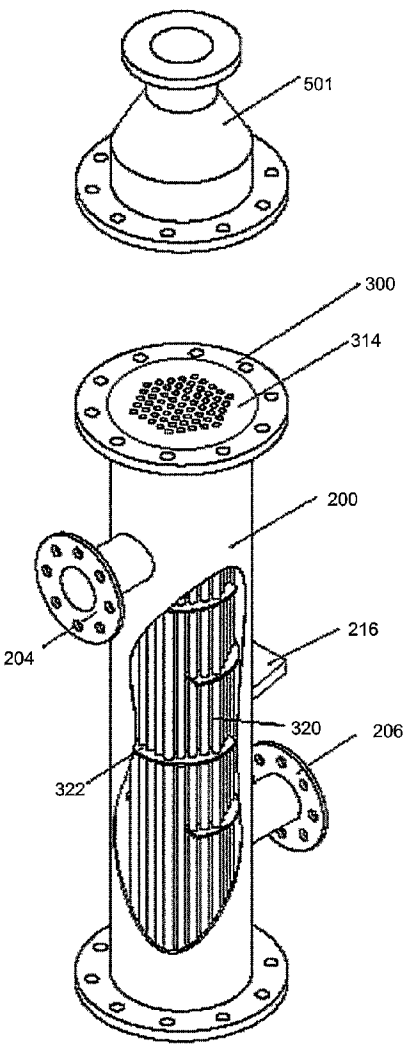
FIG. 13 illustrates an exploded partial perspective view representing an example of the shell and tube heat exchanger of FIG. 4 with a portion of the shell removed to reveal the tubes therein.

FIG. 13 illustrates an exploded partial perspective view representing an example of the shell and tube heat exchanger of FIG. 4 with a portion of the shell removed to reveal the tubes therein. As shown in FIG. 13, the heat exchanger (200) may include a baffle (322) for holding the plurality of tubes (320). The baffle may be formed of a corrosion-resistant thermoplastic polymer, such as polytetrafluoroethylene (PTFE) with sufficient high temperature resistance to handle being super heated to well-above the boiling point of hydrochloric acid.

System and Method for Pickling

Figure 14:
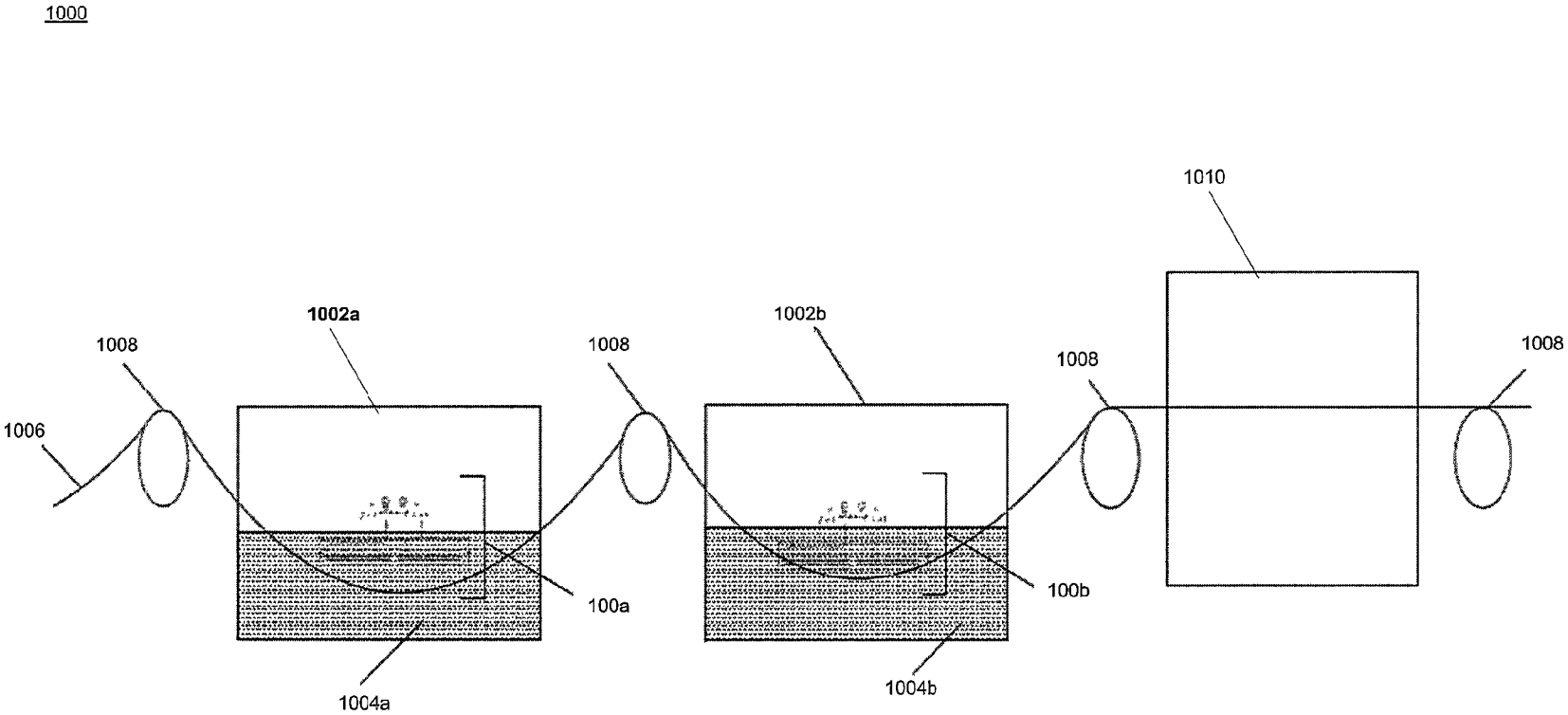
FIG. 14 depicts a steel pickling system utilizing one or more shell and tube heat exchangers in accordance with an exemplary embodiment of the present invention.
Figure 15:
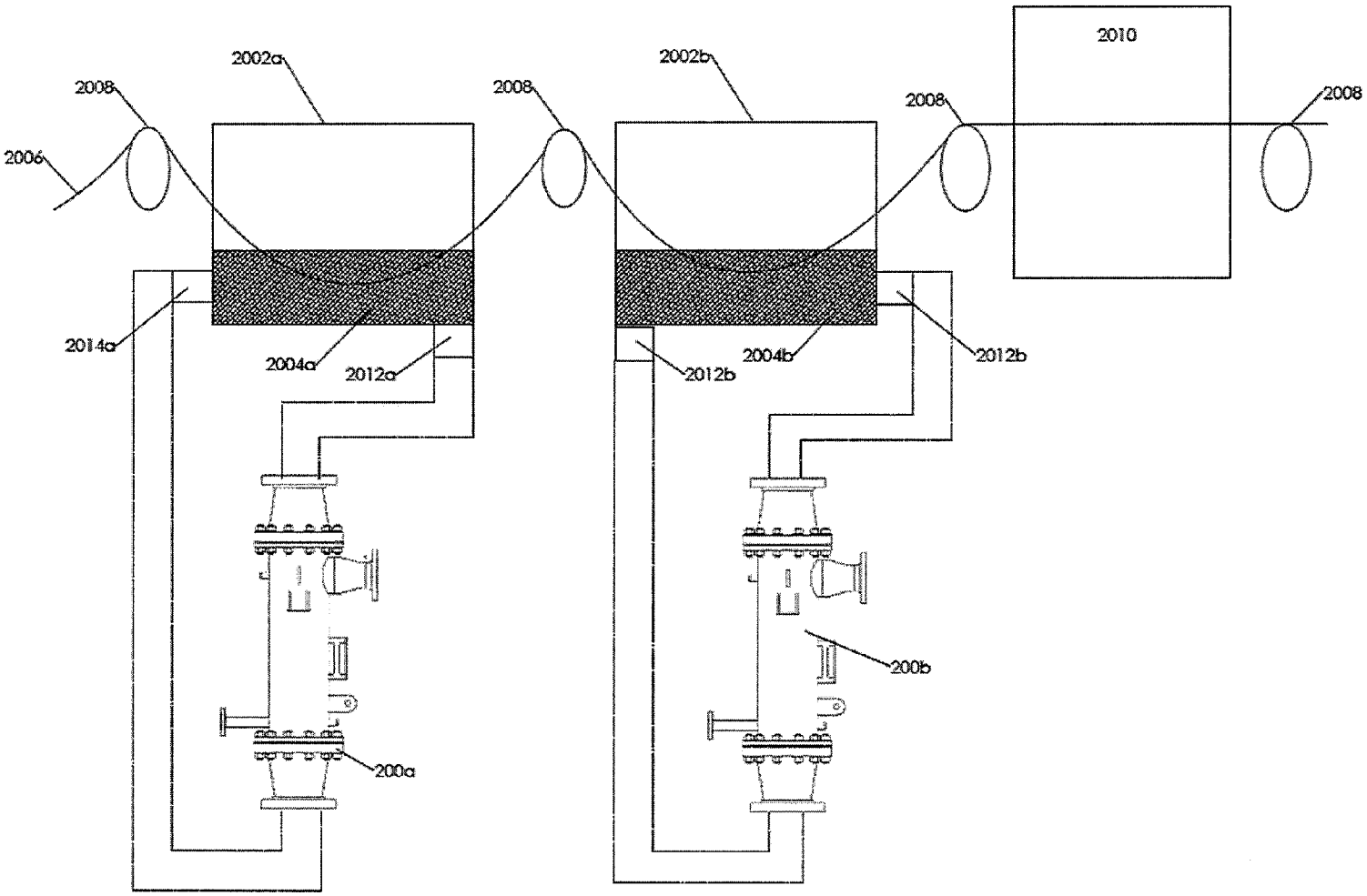
FIG. 15 depicts a steel pickling system utilizing one or more immersion coil heat exchangers in accordance with an exemplary embodiment of the present invention.

According to another embodiment of the present invention, there is a system and method for pickling. FIG. 14 depicts an embodiment of a system (1000) utilizing immersion coil heat exchangers, while FIG. 15 depicts an embodiment of the system (1100) utilizing shell and tube heat exchangers.

The systems may each include at least one pickling tank (1002*a*, 1002*b*, 2002*a*, 2002*b*) containing a pickling solution, such as hydrochloric acid and either one or more of an immersion coil heat exchanger (100*a*, 100*b*) or one or more of a shell and tube heat exchanger (200*a*, 200*b*) and a heat exchanger (100*a*, 100*b*) as described previously. Each heating exchanger is in fluid communication with a respective pickling tank for heating the pickling solution. Pickling bath temperature may be maintained at a high temperature, such as approximately 85 to 88° C. (185° F. to 190° F.).

The method for pickling may include passing a steel product (1006, 2006) through the pickling tank containing a pickling solution, such as hydrochloric acid and heating the pickling solution with the heat exchanger. In the method, at least the tubewall of at least one tube that contacts the hydrochloric acid is preferably heated above the boiling point of the hydrochloric acid to rapidly heat the hydrochloric acid.

The steel product (1006, 2006) may be in the form of a flexible sheet that is moved through the pickling line by a plurality of rollers (1008, 2008) or by other movement means. After passing through the final acid bath, the steel product (1006, 2006) may be passed through a rinsing and/or drying device (1010, 2010) which may use conventional means such as water, blown air, and/or friction to remove the acid solution from the steel product (1006, 2006).

The method of pickling may include passing the steel product through one or more tanks (1002*a*, 10012*b*, 2002*a*, 2002*b*), each containing different concentrations of hydrochloric acid, wherein at least one component associated with at least one of the tanks is formed from an alloy that predominately comprises niobium and tantalum. The one or more tanks may contain between about 4% and about 22% hydrochloric acid.

In this case, the steel product (1006, 2006) may pass through a first of the tanks (1002*a*, 2002*a*) followed by a second of the tanks (1002*b*, 2002*b*), wherein the second tank (1002*b*, 2002*b*) has a higher concentration of hydrochloric acid than the first tank (1002*a*, 2002*a*). A component, such as a heat exchanger component used with tanks having a lower concentration of hydrochloric acid may be formed from a different material, such as commercially pure niobium. For the second tank having a higher concentration of the hydrochloric acid, at least one component associated with the second tank, such as a heat exchanger component, may be exposed to the hydrochloric acid of the second tank.

Referring specifically to FIG. 14, the immersion coil heat exchanger (100*a*, 100*b*) may be used in a method of pickling a carbon steel product (1006). The steel product may be passed through a pickling line including one or more tanks (1002*a*, 1002*b*), each containing different concentrations of hydrochloric acid, such as between about 4 and about 22 weight percent hydrochloric acid heated to approximately 210° F. An immersion coil heat exchanger (100*a*, 100*b*) is immersed in each tank along with the steel product in. A heating fluid such as steam is pumped through the steam inlet, through the coil, and out through the condensate outlet. The coil includes an alloy that is predominately composed of niobium and tantalum as previously described.

Referring specifically to FIG. 15, the shell and tube heat exchanger (200) may be used in a method of pickling a carbon steel product (2006). The steel product may be passed through a pickling line including one or more tanks (2002*a*, 2002*b*), each containing different concentrations of hydrochloric acid, such as between about 4 and about 22 weight percent hydrochloric acid heated to approximately 210° F. Each tank comprises a tank inlet (2012*a*) whereby heated hydrochloric acid travels into the tank from the shell and tube heat exchanger and a tank outlet (2014*a*) whereby the hydrochloric acid leaves the tank, after which it is reheated by the heat exchanger.

The steel product may be passed through a pickling line having multiple tanks of the hydrochloric acid and each successive tank may have an increasing amount of the hydrochloric acid from about 4 to about 22 weight percent. As previously mentioned, commercially pure niobium may be used with lower concentrations of hydrochloric acid, but is preferably limited to a maximum of 8 weight percent hydrochloric acid, and more preferably limited to a maximum of 6 weight percent hydrochloric acid. The alloy of the present invention is preferably used for all of the acid concentrations that niobium can't handle.

Method for Manufacturing a Steel Product

According to either embodiment of the present invention, there is a method of manufacturing steel products. The method may include hot rolling a steel to form a hot rolled strip product according to conventional methods and thereafter pickling the steel according to the method of pickling described above.

The following described corrosion tests performed on the alloy of the present invention, showing suitability of the alloy for a component of a steel producing apparatus, such as a heat exchanger component.

First Corrosion Test—Boiling Hydrochloric Acid Solution

Corrosion immersion testing of three tantalum-niobium lots was conducted in boiling 20 wt % HCl with Ferric Chloride for 30 days. Duplicate specimens of each Ta—Nb lot were exposed.

Test Solution—The Ta—Nb test specimens were exposed to a 20 wt % HCl test solution with 200 grams of Ferric Chloride (FeCl) added per liter of solution. Approximately 4 liters of test solution was prepared by diluting (36 wt %) HCl with an appropriate amount of laboratory prepared deionized water (DIW) to yield a dilution strength of 20 wt %. Then, 200 grams of reagent grade FeCl was added to the 20 wt % HC. The solution was stirred using a magnetic stirrer until all of the FeCl was dissolved. The appearance of the test solution was dark reddish-brown.

Test Specimens—Six samples were tested. Two of the samples are identified as Alloys 1A and 1B, a second pair is identified as Alloys 2A and 2B, and a third pair is identified as Alloys 3A and 3B. All of the test specimens were given a smooth finish using 120-grit abrasive paper. Prior to exposure, each specimen was washed in soap and water, solvent degreased, and warm air-dried. The cleaned specimens were measured to the nearest 0.01 mm and weighed to the nearest 0.0001 gram.

Test Procedure—The testing consisted of duplicate specimens exposed by total immersion to approximately 600 ml of boiling test solution. Each test specimen was exposed in a separate test vessel and was suspended at an appropriate height in each test vessel using PTFE string. After 30 days of exposure, the test specimens were removed, rinsed, photographed, then cleaned, reweighed, and evaluated. The test procedures used conformed to ASTM G31, Standard Practice for Laboratory Immersion Corrosion Testing of Metals and ASTM G1, Standard Practice for Preparing, Cleaning, and Evaluating Corrosion Test Specimens.

Results—The corrosion rates of the exposed specimens were calculated based on mass loss (or gain) measurements, and are shown in Table 1. Photographs were taken of the exposed specimens after rinsing, then after several attempts at removing the tightly adherent corrosion products using a powdered cleaner and bristle brush followed by immersion in an ultrasonic cleaner. The specimens were evaluated optically for the presence of localized forms of corrosion. No evidence of localized corrosion was observed on any of the test specimens.

TABLE 1

Corrosion Testing Tantalum-Niobium in Boiling HCl—FeCl Solution for Thirty Days

| Alloy | Composition | Density | Corrosion Rate (mpy)[1] | Change (%) |
|---|---|---|---|---|
| 1A | Nb - 40 wt % Ta | 10.6 g/cc | 0.01 | <0.01 |
| 1B | Nb - 40 wt % Ta | 10.6 g/cc | 0.02 | <0.01 |
| 2A | Nb - 50 wt % Ta | 11.3 g/cc | <0.01 | <0.01 |
| 2B | Nb - 50 wt % Ta | 11.3 g/cc | <0.01 | <0.01 |
| 3A | Nb - 60 wt % Ta | 12.1 g/cc | −0.01 | −0.01 |
| 3B | Nb - 60 wt % Ta | 12.1 g/cc | −0.01 | −0.01 |

[1]mpy = mils per year, 1 mil = 0.001"

Alloys 1A and 1B—Corrosion rates are shown in Table 1. A tightly adherent multi-colored tint was observed on both specimens after exposure and after cleaning.

Alloys 2A and 2B—Corrosion rates are shown in Table 1. A tightly adherent multi-colored tint was observed on both specimens after exposure and after cleaning.

Alloys 3A and 3B—Corrosion rates are shown in Table 1. A tightly adherent multi-colored tint was observed on both specimens after exposure and after cleaning.

Discussion—Calculated corrosion rates assume uniform mass loss over the entire surface of the test specimens. As evidenced in these tests, the alloys develop a tightly adherent oxide film, which can result in a slight mass gain when little or no corrosion occurs.

These corrosion tests were conducted at about as strong and as high a temperature generally used in steel pickling applications. The results of the corrosion tests show little corrosion for the alloys. Accordingly, the alloys can be used for a component for a steel pickling apparatus that is exposed to high concentrations of hydrochloric acid even at the boiling point of the acid, with an expectation that the component will remain in service for a long period of time.

Second Corrosion Test—Superheated Hydrochloric Acid Solution

Corrosion immersion testing of three tantalum-niobium lots was conducted in 20 wt % HCl with Ferric Chloride and Ferrous Chloride at 370° F. (188° C.) for 30 days. Duplicate specimens of each Ta—Nb lot were exposed.

Test Solution—The Ta—Nb test specimens were exposed to a 20 wt % HCl test solution with 15 wt % Ferric Chloride (FeCl) and 15 wt % Ferrous Chloride. Approximately 1 liter of test solution was prepared by diluting (36 wt %) HCl with an appropriate amount of FeCl2 and FeCl3 and an appropriate amount of laboratory prepared deionized water (DIW) to yield a dilution strength of 20 wt % HCl, 15 wt % FeCl2, and 15 wt % FeCl3 per liter. The appearance of the test solution was dark reddish-brown.

Test Specimens—Six samples were tested. Two of the samples are identified as Alloys 1A and 1B, a second pair is identified as Alloys 2A and 2B, and a third pair is identified as Alloys 3A and 3B. All of the test specimens were given a smooth finish using 120-grit abrasive paper. Prior to exposure, each specimen was washed in soap and water, solvent degreased, and warm air-dried. The cleaned specimens were measured to the nearest 0.01 mm and weighed to the nearest 0.0001 gram.

Test Procedure—The testing consisted of specimens exposed by total immersion to approximately 75 ml of test solution. Each specimen was exposed in a separate test vessel. Due to the temperature of the tests exceeding the boiling point of the hydrochloric acid solution, one test specimen was placed in a small glass beaker, the beaker filled approximately ¾ full, then placed into a PTFE lined pressure containment vessel. The sealed test vessels were placed in a convection oven heated to 370° F. (188° C.) for 33 days (30 days plus 3 additional days because of a holiday). After 33 days of exposure, the test specimens were removed, cleaned, reweighed, and evaluated.

The test procedures used conformed to ASTM G31, Standard Practice for Laboratory Immersion Corrosion Testing of Metals and ASTM G1, Standard Practice for Preparing, Cleaning, and Evaluating Corrosion Test Specimens.

Results—The corrosion rates of the exposed specimens were calculated based on mass loss measurements, and are shown in Table 2. Photographs were taken of the exposed specimens after cleaning. The specimens were evaluated optically for the presence of localized forms of corrosion.

TABLE 2

Corrosion Testing Tantalum-Niobium in Superheated HCl-Ferric Chloride-Ferrous Chloride Solution at 370° F. (188° C.) for 33 Days

| Alloy | Composition | Density | Corrosion Rate (mpy)[1] | Comments |
|---|---|---|---|---|
| 1A | Nb - 40 wt % Ta | 10.6 g/cc | 5.3 | General |
| 1B | Nb - 40 wt % Ta | 10.6 g/cc | 4.2 | corrosion |
| 2A | Nb - 50 wt % Ta | 11.3 g/cc | 1.6 | General |
| 2B | Nb - 50 wt % Ta | 11.3 g/cc | 1.6 | corrosion |
| 3A | Nb - 60 wt % Ta | 12.1 g/cc | 0.4 | General |
| 3B | Nb - 60 wt % Ta | 12.1 g/cc | 0.3 | corrosion |

[1]mpy = mils per year, 1 mil = 0.001"

A heat exchanger operates at a higher temperature than the acid it is trying to heat. Accordingly, to heat hydrochloric acid to its boiling point, the heat exchanger must operate at a temperature exceeding the boiling point of hydrochloric acid. In this case, a material for a component of the heat exchanger must be resistant to corrosion upon exposure to superheated hydrochloric acid.

The above corrosion test simulates the conditions at the actual tube wall of the heat exchanger. Heat exchangers in the steel pickling industry are heated with steam as high as 150 PSIG and 365° F. Accordingly, 370° F. was selected as the test condition.

These tests have much different results than the corrosion tests in boiling acid solutions.

Alloys 1A and 1B—Specimens experienced the highest corrosion rates of the three alloys. The high corrosion rate of this alloy renders the alloy unsuitable for use in a heat exchanger for heating high concentrations of hydrochloric acid pickling solution to boiling temperatures due to the high corrosion rate of the alloy under such conditions.

Alloys 2A and 2B—Specimens experienced corrosion rates that were more than 50% lower than Alloys 1A and 1B. The alloy may be suitable for use in a heat exchanger for heating high concentrations of hydrochloric acid pickling solutions to boiling temperatures. However, the high corrosion rate of 1.6 mpy fails to ensure a long lifetime for a heat exchanger under heavy use under the harshest conditions.

Alloys 3A and 3B—The corrosion rates were much lower than the previous specimens. The low corrosion rate of 0.4 mpy suggests that the alloys can withstand heavy use as a component of a heat exchanger for use in steel pickling applications for a long time, even under the harshest conditions.

As previously explained, the above testing at 370° F. and 20% HCl was conducted to simulate the corrosive conditions at the tubewall of a steel pickling heat exchanger. The tubewall is hotter than the bulk acid temperature because of the hot steam hcating the tube. For the Nb-50 wt % Ta alloy, there was a corrosion rate of approximately 1.5 mpy (mils per year). A typical tube wall in a pickle heat exchanger is 0.015" thick. There is preferably a 4 to 1 safety factor applied to the stress calculation when designing tubing for these heat exchangers, thereby the tubing can handle at least 4 times the design pressure. Looked at another way, the tube wall is at least 4 times as thick as it needs to be to handle the tube stress of the heat exchanger when new. This safety factor is applied to make sure the heat exchanger tubing is capable of handling the stress including all the variables of manufacturing and corrosion in service. A corrosion rate of 1.5 mpy means that in 5 years the wall thickness would be reduced to 0.075" thick. This was deemed to be too much as it would lower the safety factor to a value of 2 in the corroded condition.

The 60% Tantalum/40% Niobium tube showed a corrosion rate of 0.4 mpy. This means a 0.015" wall thickness tube will corrode 0.002" in 5 years which would reduce the wall thickness to 0.013" in 5 years and 0.011" in 10 years. This means the safety factor would be reduced to 3.47 in 5 years and 2.93 in 10 years. This is acceptable and would yield a life of at least 10 years under the most aggressive conditions found in steel pickling.

According to Tables 3-6 below, material cost savings and increased initial fluid pressure capability were calculated for each of the tested alloys based on the highest experimental obtained corrosion rates to obtain final thickness of 0.010 in. (0.025 cm) considering that the present cost of tantalum is almost three times the present cost of niobium ($300/lb vs. $110/lb).

TABLE 3

Material Cost Savings and Increased Initial Fluid Pressure Capability Relative to 100% Tantalum Tubes for One Year Lifetime

| Composition | final thickness | Corrosion Rate | Starting thickness | Cost Savings | Initial Fluid Pressure Capability |
|---|---|---|---|---|---|
| Nb-40% Ta | 0.010 in. (0.025 cm) | 5.3 mpy | 0.015 in. (0.038 cm) | +39% | +50% |
| Nb-50% Ta | 0.010 in. (0.025 cm) | 1.6 mpy | 0.012 in. (0.030 cm) | +46% | +20% |
| Nb-60% Ta | 0.010 in. (0.025 cm) | 0.4 mpy | 0.010 in. (0.025 cm) | +43% | same |
| 100% Ta | 0.010 in. (0.025 cm) | 0 mpy | 0.010 in. (0.025 cm) | | |

As shown in Table 3 above, each of the three alloys shows substantial cost savings relative to 100% tantalum tubing if lifetime of the tubing is not a substantial consideration, i.e. one year lifetime. Also, the increased starting thickness of Nb-40% and Nb-50% to compensate for expected corrosion would allow for a 50% and 20% increase in the initial fluid pressure.

TABLE 4

Material Cost Savings and Increased Initial Fluid Pressure Capability Relative to 100% Tantalum Tubes for Five Year Lifetime

| Composition | final thickness | Corrosion Rate | Starting thickness | Cost Savings | Initial Fluid Pressure Capability |
|---|---|---|---|---|---|
| Nb-40% Ta | 0.010 in. (0.025 cm) | 5.3 mpy | 0.037 in. (0.094 cm) | none | |
| Nb-50% Ta | 0.010 in. (0.025 cm) | 1.6 mpy | 0.018 in. (0.046 cm) | +16% | +80% |
| Nb-60% Ta | 0.010 in. (0.025 cm) | 0.4 mpy | 0.012 in. (0.030 cm) | +35% | +20% |
| 100% Ta | 0.010 in. (0.025 cm) | 0 mpy | 0.010 in. (0.025 cm) | | |

As shown in Table 4 above, assuming a five year lifetime under constant exposure to the highest concentrations of superheated hydrochloric acid, Nb-50% Ta and Nb-60% Ta both show substantial cost savings and increased initial fluid pressure capability, leading to the suggestion that either of the alloys would be viable substitutes for tantalum tubing even in the harshest conditions for long periods of time.

TABLE 5

Material Cost Savings and Increased Initial Fluid Pressure Capability Relative to 100% Tantalum Tubes for Ten Year Lifetime

| Composition | final thickness | Corrosion Rate | Starting thickness | Cost Savings | Initial Fluid Pressure Capability |
|---|---|---|---|---|---|
| Nb-40% Ta | 0.010 in. (0.025 cm) | 5.3 mpy | 0.063 in. (0.160 cm) | none | |
| Nb-50% Ta | 0.010 in. (0.025 cm) | 1.6 mpy | 0.026 in. (0.066 cm) | none | |
| Nb-60% Ta | 0.010 in. (0.025 cm) | 0.4 mpy | 0.014 in. (0.036 cm) | +24% | +40% |
| 100% Ta | 0.010 in. (0.025 cm) | 0 mpy | 0.010 in. (0.025 cm) | | |

As shown in Table 5 above, assuming that assurance of a ten year life time exposure to the harshest conditions is desired, Nb-60% shows a substantial cost savings and increased initial fluid pressure capability relative to tantalum tubes.

TABLE 6

Material Cost Savings and Increased Initial Fluid Pressure Capability Relative to 100% Tantalum Tubes for Twenty Year Lifetime

| Composition | final thickness | Corrosion Rate | Starting thickness | Cost Savings | Initial Fluid Pressure Capability |
|---|---|---|---|---|---|
| Nb-40% Ta | 0.010 in. (0.025 cm) | 5.3 mpy | 0.116 in. (0.295 cm) | none | |
| Nb-50% Ta | 0.010 in. (0.025 cm) | 1.6 mpy | 0.042 in. (0.107 cm) | none | |
| Nb-60% Ta | 0.010 in. (0.025 cm) | 0.4 mpy | 0.018 in. (0.046 cm) | +2% | +80% |
| 100% Ta | 0.010 in. (0.025 cm) | 0 mpy | 0.010 in. (0.025 cm) | | |

As shown in Table 6 above, even if a twenty year lifetime was desired, the above results show that Nb-60% would be competitive with tantalum tubes and would have a substantial advantage in fluid pressure capability during the initial years of the twenty year lifetime.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A heat exchanger for heating a hydrochloric acid pickling solution, the heat exchanger comprising:

a first tubesheet disposed at a first end of a plurality of the tubes;

a second tubesheet disposed at a second end of the plurality of tubes; and a shell surrounding the plurality of tubes, the shell comprising:

a tubeside inlet for flowing hydrochloric acid through the first tubesheet and the plurality of tubes;

a tubeside outlet for flowing the heated hydrochloric acid from the plurality of tubes and the second tubesheet;

a shellside inlet for flowing a heating fluid into the shell to heat the plurality of tubes; and a shellside outlet for flowing the heating fluid out of the shell, wherein at least one tube or at least one tubesheet includes an alloy that comprises niobium and tantalum and wherein the alloy comprises at least 30 weight percent tantalum and at least 25 weight percent niobium.

2. The heat exchanger of claim 1, wherein the first and second tubesheets comprise a substrate formed of a material other than the alloy, wherein a liner is disposed on a side of each tubesheet facing away from the plurality of tubes, and wherein the liner is formed from the alloy.

3. The heat exchanger of claim 1, wherein the shellside outlet includes a shellside vent for releasing non-condensables from the shell and a shellside drain for draining excess liquid.

4. A system for pickling, comprising:

a pickling tank containing hydrochloric acid; and the heat exchanger of claim 1 in fluid communication with the pickling tank for heating the hydrochloric acid.

5. A method for pickling, comprising:

passing a steel product through a pickling tank containing hydrochloric acid; and heating the hydrochloric acid with the heat exchanger of claim 1.

6. The method of claim 5, wherein at least the tubewall of the at least one tube that contacts the hydrochloric acid is heated above the boiling point of the hydrochloric acid.

7. A method of manufacturing a steel product, comprising:

hot rolling a steel to form a hot rolled strip product; and pickling the strip according to the method of claim 5.

8. The heat exchanger of claim 1, wherein the alloy comprises at least 45 weight percent tantalum and at least 25 percent niobium.

9. The heat exchanger of claim 1, wherein the alloy comprises at least 55 weight percent tantalum and at least 25 percent niobium.

10. The heat exchanger of claim 1, wherein the alloy comprises at least 30 percent tantalum and at least 35 weight percent niobium.

11. The heat exchanger of claim 1, wherein the alloy comprises at least 45 percent tantalum and at least 35 weight percent niobium.

12. The heat exchanger of claim 1, wherein the alloy comprises at least 55 percent tantalum and at least 35 weight percent niobium.

13. The heat exchanger of claim 1, wherein the at least one tube that includes the alloy has a wall thickness of 0.1 inch (2.54 mm) or less.

14. The heat exchanger of claim 1, wherein the at least one tube that includes the alloy has a wall thickness of 0.03 inch (0.76 mm) or less.

15. The heat exchanger of claim 1, wherein the at least one tube that includes the alloy has a wall thickness of 0.015 inch (0.38 mm) or less.

16. A heat exchanger for heating a hydrochloric acid pickling solution, the heat exchanger comprising:

a steam inlet;

a coil of at least one tube, wherein the coil transfers heat from steam passing therethrough to hydrochloric acid contacting an exterior of the coil; and a condensate outlet for removing condensed steam from the coil, wherein the at least one tube includes an alloy that comprises niobium and tantalum, and wherein the alloy comprises at least 30 weight percent tantalum and at least 25 weight percent niobium.

17. The heat exchanger of claim 16, further comprising an inlet manifold that separates the steam into a plurality of the tubes, and an outlet manifold that merges condensed steam from the plurality of tubes.

18. The heat exchanger of claim 16, further comprising a cage for supporting the coil, wherein the cage comprises at least one of polypropylene and polytetrafluoroethylene.

19. A system for pickling, comprising:

a pickling tank containing hydrochloric acid; and the heat exchanger of claim 16 in fluid communication with the pickling tank for heating the hydrochloric acid.

20. A method for pickling, comprising:

passing a steel product through a pickling tank containing hydrochloric acid; and heating the hydrochloric acid with the heat exchanger of claim 16.

21. The method of claim 20, wherein at least the tubewall of the at least one tube that contacts the hydrochloric acid is heated above the boiling point of the hydrochloric acid.

22. A method of manufacturing a steel product, comprising:

hot rolling a steel to form a hot rolled strip product; and pickling the strip according to the method of claim 20.

23. The heat exchanger of claim 16, wherein the alloy comprises at least 45 weight percent tantalum and at least 25 weight percent niobium.

24. The heat exchanger of claim 16, wherein the alloy comprises at least 55 weight percent tantalum and at least 25 weight percent niobium.

25. The heat exchanger of claim 16, wherein the alloy comprises at least 30 weight percent tantalum and at least 35 weight percent niobium.

26. The heat exchanger of claim 16, wherein the alloy comprises at least 45 weight percent tantalum and at least 35 weight percent niobium.

27. The heat exchanger of claim 16, wherein the alloy comprises at least 55 weight percent tantalum and at least 35 weight percent niobium.

28. The heat exchanger of claim 16, wherein the at least one tube that includes the alloy has a wall thickness of 0.1 inch (2.54 mm) or less.

29. The heat exchanger of claim 16, wherein the at least one tube that includes the alloy has a wall thickness of 0.03 inch (0.76 mm) or less.

30. The heat exchanger of claim 16, wherein the at least one tube that includes the alloy has a wall thickness of 0.015 inch (0.38 mm) or less.

* * * * *